US007296317B2

(12) United States Patent
Grace

(10) Patent No.: US 7,296,317 B2
(45) Date of Patent: Nov. 20, 2007

(54) BOX BEAM BRIDGE AND METHOD OF CONSTRUCTION

(75) Inventor: Nabil F. Grace, Rochester Hills, MI (US)

(73) Assignee: Lawrence Technological University, Southfield, MI (US)

( * ) Notice: Subject to any disclaimer, the term of this patent is extended or adjusted under 35 U.S.C. 154(b) by 0 days.

(21) Appl. No.: 11/350,578

(22) Filed: Feb. 9, 2006

(65) Prior Publication Data

US 2007/0180634 A1 Aug. 9, 2007

(51) Int. Cl.
*E01D 19/12* (2006.01)
*E01D 21/00* (2006.01)
*E01C 11/16* (2006.01)

(52) U.S. Cl. ..... 14/73; 14/77.1; 14/78; 404/47; 52/223.7

(58) Field of Classification Search ..... 14/77.1, 14/78, 74.5; 404/47; 52/223.7
See application file for complete search history.

(56) References Cited

U.S. PATENT DOCUMENTS 2,101,538 A * 12/1937 Faber ..... 52/223.7
3,398,498 A * 8/1968 Krauss ..... 52/691
3,906,687 A * 9/1975 Schupack ..... 52/87
4,366,655 A * 1/1983 Mayer et al. ..... 52/223.7
4,453,283 A * 6/1984 Fitzgerald-Smith et al. ... 14/73
4,620,400 A * 11/1986 Richard ..... 52/223.9
5,437,072 A * 8/1995 Dinis et al. ..... 14/73
5,457,839 A * 10/1995 Csagoly ..... 14/73
6,065,257 A * 5/2000 Nacey et al. ..... 52/223.8
6,138,309 A * 10/2000 Tadros et al. ..... 14/25
6,145,270 A * 11/2000 Hillman ..... 52/731.1
6,176,051 B1 * 1/2001 Sorkin ..... 52/223.13
6,751,821 B1 * 6/2004 Han ..... 14/74.5
6,790,518 B2 9/2004 Grace et al.
6,832,454 B1 * 12/2004 Iyer ..... 52/223.4
6,857,156 B1 * 2/2005 Grossman ..... 14/73
2004/0216249 A1 * 11/2004 El-Badry ..... 14/13

OTHER PUBLICATIONS

New York State Department of Transportation (NYSDOT) Bridge Design Sheets BD-PA3 to BD-PA5 (Prestressed Concrete Box Beams) issued Jan. 26, 2005 by the NYSDOT Chief Engineer (Structures) to provide guidelines for NYSDOT standards of bridge design.*

Saito, M., "Carbon Fiber Composites in the Japanese Civil Engineering Market—Conventional Uses and Developing Products", SAMPE Journal, vol. 38, No. 5, Sep./Oct. 2002, pp. 20-25.

Nippon Steel Composite Co., Ltd. Brochure—FRP Grid Forca Towgrid (4 pages).

Nefcom Corporation Brochure—FRP Reinforcing Bar NEFMAC (4 pages).

* cited by examiner

*Primary Examiner*—Raymond W Addie
(74) *Attorney, Agent, or Firm*—Dickinson Wright PLLC

(57) ABSTRACT

An improved box beam bridge and a method of construction are disclosed. The box beam bridge comprises a plurality of box beams for each lane structure of the bridge. Each of these lane structures are separately secured together and post-tensioned by means of a composite material strand. The separate lane structures are then brought together to complete the bridge width, with an interstitial box beam placed between the separate lane structures. Once arranged together, the separate lane structures and integrated interstitial box beam are secured together and post-tensioned by a second composite material strand that runs the entire width of the bridge.

20 Claims, 2 Drawing Sheets

BOX BEAM BRIDGE AND METHOD OF CONSTRUCTION

BACKGROUND OF THE INVENTION

The present invention is generally directed to an improved box beam bridge, a method of constructing an improved box beam bridge and a method of repairing an improved box beam bridge or replacing its components.

Box beam bridges are well-known in the art. The typical method used to construct box beam bridges is as follows. First, a number of box beams are constructed and positioned side-by-side so that each box beam traverses the span of the bridge. Typically these box beams include a number of transverse diaphragms located along the length of, and perpendicular to, the box beams. The transverse diaphragms include a circular hole designed to receive a post-tensioning steel cable, as described more fully below. The box beams are arranged such that the circular holes of the transverse diaphragms of adjacent box beams are aligned. Once positioned and aligned, the box beams are then secured to one another by a steel cable that travels through the circular hole of the transverse diaphragm of each box beam. This steel cable is used to create post-tensioned force in the transverse direction, which inhibits differential movement of adjacent box beams. Such differential movement can lead to cracking of the concrete deck slab that is placed on top of the box beams and/or bridge failure, e.g., by shearing the steel cable at the junction of two adjacent box beams.

Once the box beams are secured together by the steel cable and the bridge width is post-tensioned, a concrete deck slab is applied to the top portion of the bridge. This deck slab comprises the surface of the bridge. Once the deck slab is applied, the bridge is once again post-tensioned (the force being generated by the steel cable) so that the bridge and deck slab are prestressed in the transverse direction in order to resist traffic loads. At this point, grout is used to fill in any opening in the circular holes of the transverse diaphragm that remains unfilled by the steel cable. This grout is also used to cover the steel cable, in order to protect it from corrosion, and bond it to the transverse diaphragm. When hardened, this grout bonds to the steel cable, the transverse diaphragm and the circular holes therein in order to create a unitary bridge construction made up of a plurality of box beams secured together.

This typical box beam bridge construction has a number of limitations. First, the grout used to protect the steel cable from corrosion tends to deteriorate with age, resulting in a weakening of the entire bridge structure and possible corrosion of the steel cable itself. Second, the use of circular holes in the transverse diaphragms results in a number of alignment problems with adjacent box beams. Each box beam is constructed such that it has a camber, however, the camber between any two box beams may not be completely uniform. Because of variations in the camber of box beams, alignment problems between the circular holes of adjacent box beams may arise. Third, the use of grout to fill in the openings of the circular hole/steel cable junction and to protect the steel cable itself requires that the entire bridge structure be replaced when one box beam of the bridge structure becomes damaged or deteriorates. A box beam bridge structure (and a method of constructing such a box beam bridge) that addresses these limitations has yet to be satisfactorily addressed in the art.

SUMMARY OF THE INVENTION

In view of the above, a need exists for an improved box beam bridge and method of construction that addresses the limitations of conventional box beam bridges. More particularly, a need exists for an improved box beam bridge, and a method of constructing a box beam bridge, that (1) does not use a steel cable that will corrode and/or deteriorate with age, (2) provides for variations in the camber of box beams, and (3) allows for replacement of a damaged or deteriorated box beam or beams without replacing the entire bridge structure.

To meet these and other needs that will be apparent to those skilled in the art based upon this description and the appended drawings, the present invention is directed to a bridge comprising a first lane structure with at least two first lane box beams arranged substantially side-by-side. The at least two first lane box beams are secured in a transverse direction by a first composite material strand or grouping of strands. The bridge further includes a second lane structure being arranged substantially parallel and next to the first lane structure. The second lane structure also comprises at least two second lane box beams arranged substantially side-by-side that are secured in a transverse direction by a second composite material strand or grouping of strands. The bridge also comprises an interstitial box beam arranged between the first and second lane structures. A third composite material strand is used to secure the first lane structure, the second lane structure and the interstitial box beam in a transverse direction. Finally, a deck slab is arranged upon the first lane structure, the second lane structure and the interstitial box beam to complete the surface of the bridge.

In another embodiment of the present invention, a method of constructing a bridge with box beams is disclosed. In this method, at least two first lane box beams are arranged substantially side-by-side. These at least two first lane box beams are secured to each other in a transverse direction by a first composite material strand to form a first lane structure. Similarly, at least two second lane box beams are arranged substantially side-by-side and secured to each other in a transverse direction by a second composite material strand to form a second lane structure. An interstitial box beam is positioned between the first and second lane structures, and a third composite material strand is used to secure the first lane structure, the second lane structure and the interstitial box beam in a transverse direction. A deck slab is then placed over the first lane structure, the second lane structure and the interstitial box beam.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

An improved box beam bridge and a method of construction according to the present invention are described with reference to FIGS. 1-3. It should be appreciated that the applications for the improved box beam bridge and a method of construction according to the present invention may be used in a variety of applications beside the illustrated system. For example, the present invention may be used to form bridges for railway systems, pedestrian walkways and other non-automobile road applications.

Figure 1:
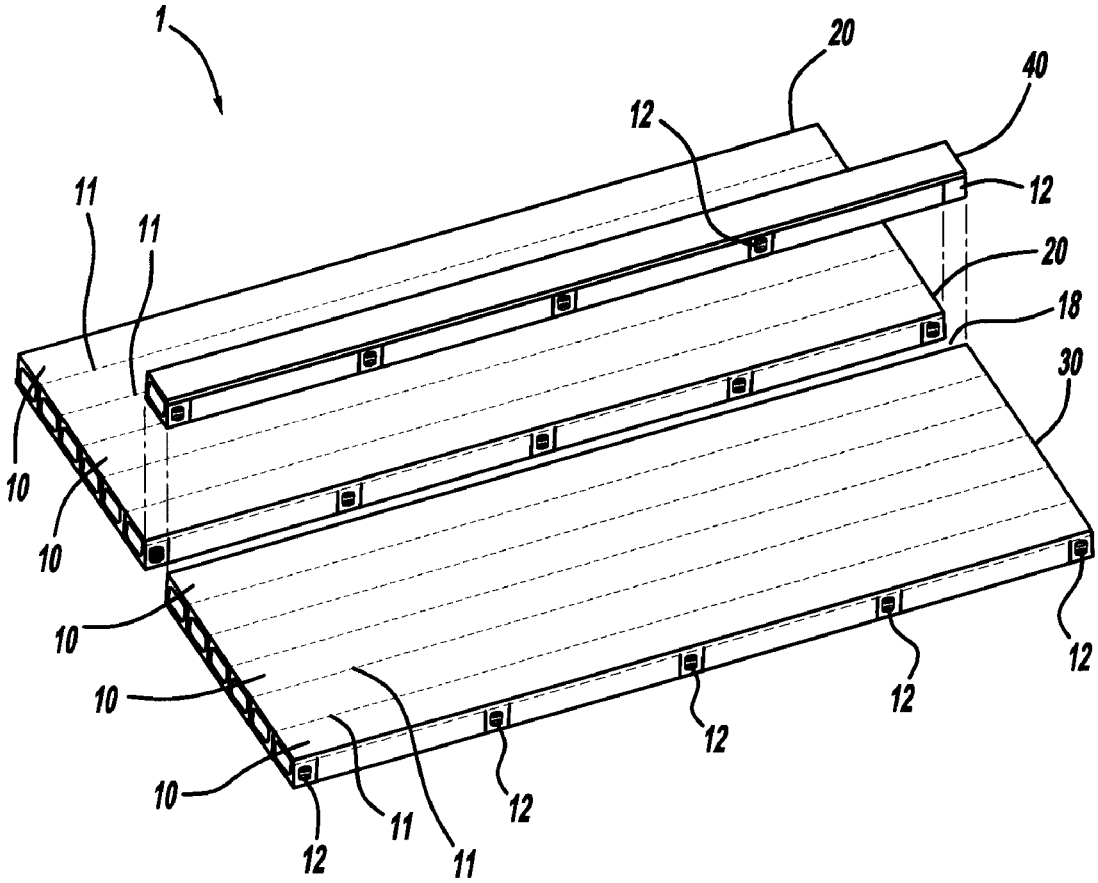
FIG. 1 is a partial offset overhead view of an exploded improved box beam bridge according to one embodiment of the present invention.
Figure 2:
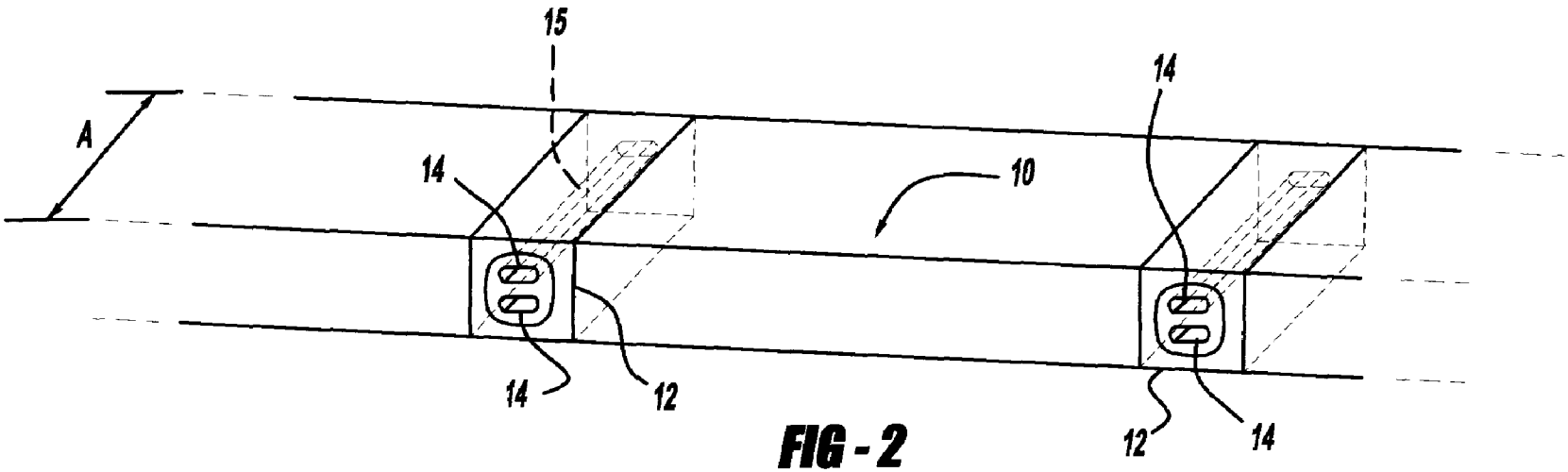
FIG. 2 is a partial view of a box beam construction used in an improved box beam bridge according to one embodiment of the present invention.

As shown in FIG. 1, an improved box beam bridge 1 is made up of a number of singular box beams 10 arranged side-by-side. These box beams 10 are preferably prestressed concrete box beams, as is well known in the art, however reinforced concrete box beams and other box beam constructions may be used instead. The bridge 1 of FIG. 1 is shown with thirteen box beams 10 (including the interstitial box beam 40 described below), however any number of box beams 10 may be used to make up bridge 1. A bridge 1 of FIG. 1 as shown includes two separate lane structures—a first lane structure 20 and second lane structure 30, however any number of separate lane structures may be used with a bridge design according to the present invention. Each of the box beams 10 includes a plurality of transverse diaphragms 12 distributed along the length of the box beams 10. These transverse diaphragms 12 are shown in more detail in FIG. 2, which illustrates the details of an exemplary box beam 10. Each of the illustrated transverse diaphragms 12 include two openings 14 that pass completely through the box beam 10 in the transverse direction (shown as dimension A in FIG. 2) to create passages 15. These passages 15 are used to secure and post-tension the box beams 10, as described below. In a preferred embodiment, the openings 14 are ellipsoidal in shape. This ellipsoidal shape is preferred because it reduces or eliminates the possibility of misalignment between the circular holes of prior art adjacent box beams, as described in the "Background of the Invention" section above.

Referring again to FIG. 1, a first lane structure 20 is comprised up of at least two box beams 10 arranged side-by-side. In a preferred embodiment, during the construction process these box beams 10 are abutted against one another lengthwise and arranged such that the transverse diaphragms 12 of each of the box beams are aligned. In another embodiment, a separation is left between adjacent box beams. In the preferred embodiment where the box beams 10 are abutted against one another, typically there will be a small gap 11 at the junction of adjacent box beams 10. During the construction process, this gap 11 will be grouted, preferably using a high-strength structural concrete grout, to create a relatively smooth base on top of the first lane structure 20. When the box beams 10 are aligned, the passages 15 of each box beam 10 are also aligned such that the lane structure 20 has a plurality of open passageways completely through the first lane structure 20 along the transverse direction.

Figure 3:
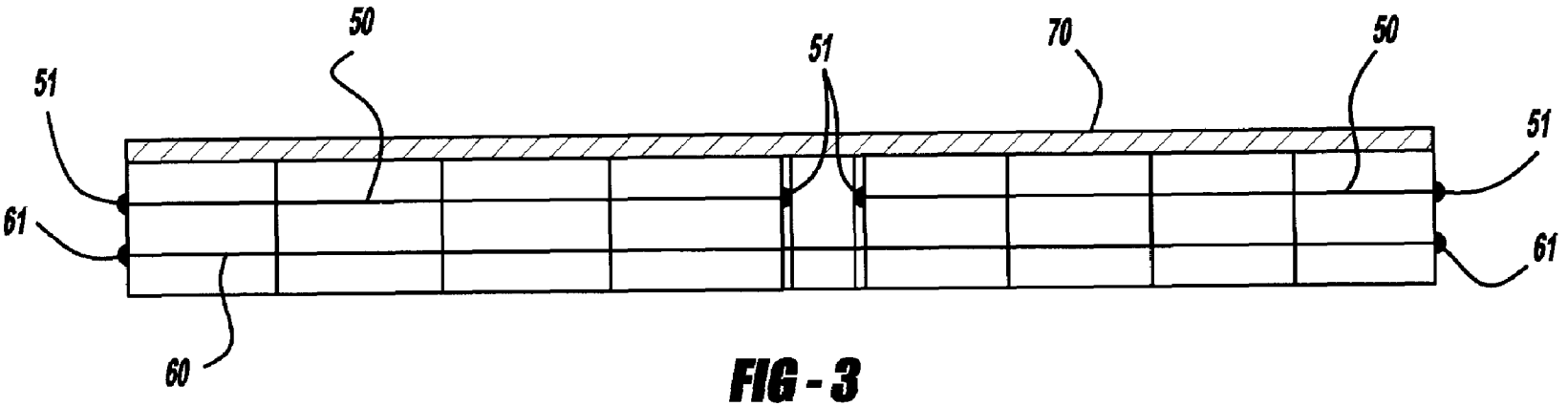
FIG. 3 is cutaway front view of an improved box beam bridge according to one embodiment of the present invention.

At this point in the construction process, the box beams 10 of the first lane structure 20 are secured to each other by means of a composite strand 50, as shown in FIG. 3. This composite strand 50 is preferably an unbonded carbon fiber reinforced polymer, however it can be made of any composite material (e.g., basalt, glass, aramid). The composite strand 50 is threaded through one of the openings 14 in the transverse diaphragms 12 of each of the box beams 10. In a preferred embodiment, the top opening 14 is used to secure the first lane structure 20. By using a composite material to form the strand 50, instead of steel, there is no need to grout the strand and the openings 14 to prevent corrosion, and therefore the strand is left unbonded to the transverse diaphragm 12, openings 14 and other bridge 1 components. Once the composite thread 50 is threaded through the full width of the first lane structure 20, the first lane structure is partially post-tensioned using the composite strand 50 to apply the post-tensioning force in the transverse direction. This is accomplished by applying anchor heads 51 to the end of the composite strand 50 when sufficient force has been applied to the box beams 10 in the transverse direction, as is well known in the art. These anchor heads 51 are preferably made of stainless steel, although other materials may be used. In a preferred embodiment, the transverse diaphragms 12 of the final interior box beam 20*a* include recessed areas that are capable of receiving the anchor heads 51 of the composite strands 50 such that these anchor heads 51 do not protrude from the transverse diaphragm 12 and interfere with the remaining construction process.

In a preferred embodiment, the post-tensioning force at this point of the construction process is 50% of the total amount of required post-tensioning force, however any percentage of the total amount of required post-tensioning force is adequate so long as (1) differential movement of the box beams 10 is inhibited to prevent shearing of the composite strand 50, and (2) the post-tensioning force is sufficient to provide for the superimposed load anticipated during the construction process.

After the first lane structure 20 has been partially post-tensioned and secured, a reinforced deck slab is preferably placed on top of the first lane structure 20. As described more fully below, this deck slab portion will be bonded to the other deck slab portions of the interstitial beam 40 and second lane portion 30 to create the bridge deck slab 70. Once the first lane portion of the deck slab 70 is complete, the first lane structure 20 is once again post-tensioned by means of the composite strand 50. At this point, however, the total amount of required post-tensioning force is applied so that the first lane structure 20 is assembled and prepared for use.

The same process as is immediately described above is performed for the second lane structure 30 such that the second lane structure 30, including the second lane portion of the deck slab 70, is assembled and prepared for use. At this point, the bridge structure 1 is comprised of the first lane structure 20 and the second lane structure 30, with an opening 18 between these two structures for receiving the interstitial box beam 40. The interstitial box beam 40 is placed in this opening 18 and aligned such that the openings 14 in the transverse diaphragms 12 of the interstitial box beam 40 are aligned with the openings 14 in the first and second lane structures, 20 and 30 respectively. A full bridge width composite strand 60 is then threaded through the openings 14 of the first lane structure 20, second lane structure 30 and interstitial box beam 40. In a preferred embodiment, the bottom opening 14 is used for receiving full bridge width composite strand 60. This composite strand 60 will run the complete bridge width and include anchor heads 61 similar to those described above with respect to composite strand 50. The full bridge width composite strand 60 will then be used to secure and post-tension the completed bridge structure 1. In a preferred embodiment, the post-tensioning force for the full bridge width composite strand 60 at this point of the construction process is 50% of the total amount of required post-tensioning force, however any percentage of the total amount of required post-tensioning force is adequate so long as (1) differential movement of the box beams 10 is inhibited to prevent shearing of the composite strand 60, and (2) the post-tensioning force is sufficient to provide for the superimposed load anticipated during the construction process.

After the bridge structure 1 has been partially post-tensioned and secured, a deck slab is preferably placed on top of the interstitial beam 40. This deck slab portion will be bonded to the other deck slab portions of the first lane structure 20 and second lane structure 30 to create the bridge deck slab 70. In a preferred embodiment, the three deck slab portions will be bonded together by means of an epoxy, most preferably, SIKADUR®32 epoxy, as is known in the art. Once the deck slab 70 is complete, the entire bridge structure 1 is once again post-tensioned by means of the composite strand 60. At this point, however, the full amount of required post-tensioning force is applied so that the bridge structure 1 is assembled and prepared for use, i.e., prestressed in the transverse direction in order to resist traffic loads. The completed bridge structure 1 is shown in FIG. 3, which illustrates the two lane width composite strands 50 (present in the top one of the two openings 14 in the box beams 10) and the full bridge width composite strand 60 (present in the bottom one of the two openings 14 in the box beams 10).

One of the key advantages to the improved box beam bridge construction 10 of the present invention is the improved ability to remove and replace one of the box beams 10 without destructing and reconstructing the entire bridge 1. This is accomplished by first removing the anchor heads 61 from the full bridge width composite strand 60. Then the interstitial box beam 40 (including its portion of the deck slab 70) is saw-cut and removed from the bridge structure 1, its portion of the deck slab 70 is removed, and the interstitial box beam 40 is stored for later use. The lane structure that includes the box beam 10 to be replaced is then released from post-tensioning by removing the anchor heads 51 from the lane width composite strand 50 in the same process as described above with respect to removing the full bridge width composite strand 60 from the bridge structure 1. The damaged box beam 10 with its portion of the deck slab 70 is saw-cut and removed from its lane structure, and a replacement box beam 10 is placed in its stead (and fully aligned with the remaining box beams of the lane structure). The lane width composite strand 50 is then re-inserted into the openings 14 of the transverse diaphragms 12 of the box beams 10, and the lane structure is partially post-tensioned, preferably to 50% of the total amount of required post-tensioning force, as is more fully described above with respect to the initial construction. A reinforced deck slab 70 portion is then placed on the replaced box beam 10, which is then bonded to the existing deck slab portions already present on the lane structure. The lane structure is then completely post-tensioned, as is more fully described above with respect to the initial construction. The interstitial box beam 40 is then repositioned between the two lane structures, and the full bridge width composite strand 60 is then threaded through the openings 14 of the first lane structure 20, second lane structure 30 and interstitial box beam 40. The bridge structure 1 is then partially post-tensioned in a process similar to that described above. A deck slab 70 portion is then placed on the interstitial box beam 40 and is bonded to the portions of the deck slab from the first and second lane structures to form a unitary deck slab 70. Finally, the entire bridge structure 1 is once again post-tensioned by means of the composite strand 60 to the full amount of required post-tensioning force so that the bridge structure 1 is assembled and prepared for use.

The foregoing discussion discloses and describes an exemplary embodiment of the present invention. Specifically, the above description describes a preferred embodiment of the present invention, however the principles of the present invention can be applied to other constructions and can be constructed in other ways. For example, there is no limitation to the number of lane structures or interstitial beams that can be used in the present invention. One can use the present invention with three lane structures and two interstitial beams, six lane structures and five interstitial beams. The present invention merely provides that an interstitial beam be placed between two adjacent lane structures. In another embodiment of the present invention, the box beams 10 of the bridge structure 1, though still placed side-by-side, are separated from one another by a gap. In this embodiment, a bridge may be constructed to be wider than the aggregate width of the total number of box beams used in its construction. This embodiment, however, requires that the transverse diaphragms 12 of the box beams 10 be wider than the box beams 10 themselves, i.e., the transverse diaphragms 12 travel the entire bridge width while the box beams are present only at predetermined intervals of the bridge width with a gap between adjacent box beams. One skilled in the art will readily recognize from such discussion, and from the accompanying drawings and claims that various changes, modifications and variations can be made therein without departing from the true spirit and fair scope of the invention as defined by the following claims.

What is claimed is:

1. A box beam bridge, comprising:

a first lane structure, said first lane structure comprising at least two first lane box beams arranged substantially side-by-side, wherein said at least two first lane box beams are secured and post-tensioned in a transverse direction by a first non-metallic composite material strand, a second lane structure being arranged substantially parallel and next to said first lane structure, said second lane structure comprising at least two second lane box beams arranged substantially side-by-side, wherein said at least two second lane box beams are secured and post-tensioned in a transverse direction by a second non-metallic composite material strand, an interstitial box beam arranged between said first and second lane structures, a third non-metallic composite material strand, wherein said third non-metallic composite material strand secures and post-tensions said first lane structure, said second lane structure and said interstitial box beam in a transverse direction, and a deck slab, said deck slab arranged upon said first lane structure, said second lane structure and said interstitial box beam.

2. The box beam bridge according to claim 1, wherein each of said at least two first lane box beams comprises a first lane transverse diaphragm, wherein each of said first lane transverse diaphragms comprises at least two first lane openings and further wherein each of said at least two second lane box beams comprises a second lane transverse diaphragm, wherein each of said second lane transverse diaphragms comprises at least two second lane openings.

3. The box beam bridge according to claim 2, wherein said at least two first lane openings and said at least two second lane openings are ellipsoidal in shape.

4. The box beam bridge according to claim 2, wherein said at least two first lane box beams are secured in said transverse direction by said first non-metallic composite material strand being threaded through a first one of said at least two first lane openings and further wherein said at least two second lane box beams are secured in said transverse direction by said second non-metallic composite material strand being threaded through a first one of said at least two second lane openings.

5. The box beam bridge according to claim 4, wherein said first lane structure, said second lane structure and said interstitial box beam are secured in said transverse direction by said third non-metallic composite material strand being thread through a second one of said at least two first lane openings, a second one of said at least two second lane openings and an interstitial box beam opening, said interstitial box beam opening being present in an interstitial box beam transverse diaphragm present in said interstitial box beam.

6. The box beam bridge according to claim 5, wherein said first lane transverse diaphragm of an interior one of said at least two first lane box beams further comprises a recessed area, said recessed area being capable of receiving an anchor head of said first non-metallic composite material strand.

7. The box beam of claim 1, further comprising a structural grout, said structural grout being placed in a gap, said gap being present between said at least two first lane box beams.

8. The box beam bridge according to claim 7, wherein each of said at least two first lane box beams comprises a first lane transverse diaphragm, wherein each of said first lane transverse diaphragms comprises at least two first lane openings and further wherein each of said at least two second lane box beams comprises a second lane transverse diaphragm, wherein each of said second lane transverse diaphragms comprises at least two second lane openings.

9. The box beam bridge according to claim 8, wherein said at least two first lane box beams are secured in said transverse direction by said first non-metallic composite material strand being threaded through a first one of said at least two first lane openings and further wherein said at least two second lane box beams are secured in said transverse direction by said second non-metallic composite material strand being threaded through a first one of said at least two second lane openings.

10. The box beam bridge according to claim 9, wherein said first lane structure, said second lane structure and said interstitial box beam are secured in said transverse direction by said third non-metallic composite material strand being thread through a second one of said at least two first lane openings, a second one of said at least two second lane openings and a first one of at least two interstitial box beam openings, said at least two interstitial box beam openings being present in an interstitial box beam transverse diaphragm present in said interstitial box beam.

11. A method of constructing a bridge with box beams, comprising the steps:

arranging at least two first lane box beams substantially side-by-side, securing and post-tensioning said at least two first lane box beams in a transverse direction by a first non-metallic composite material strand to form a first lane structure, arranging at least two second lane box beams substantially side-by-side, securing and post-tensioning said at least two second lane box beams in a transverse direction by a second non-metallic composite material strand to form a second lane structure, arranging an interstitial box beam between said first and second lane structures, securing and post-tensioning said first lane structure, said second lane structure and said interstitial box beam in a transverse direction with a third non-metallic composite material strand, placing a deck slab over said first lane structure, said second lane structure and said interstitial box beam, and post-tensioning said deck slab, said first lane structure, said second lane structure and said interstitial box beam.

12. The method of claim 11, wherein the step of securing and post-tensioning said at least two first lane box beams in said transverse direction by said first non-metallic composite material strand to form said first lane structure comprises the step of threading said first non-metallic composite material strand through a first one of a plurality of first lane openings of a first lane transverse diaphragm of said first lane box beams.

13. The method of claim 12, wherein the step of securing and post-tensioning said at least two second lane box beams in said transverse direction by said second non-metallic composite material strand to form said second lane structure comprises the step of threading said second non-metallic composite material strand through a first one of a plurality of second lane openings of a second lane transverse diaphragm of said second lane box beams.

14. The method of claim 13, wherein the step of securing and post-tensioning said first lane structure, said second lane structure and said interstitial box beam in said transverse direction with said third non-metallic composite material strand comprises the steps of:

threading said third non-metallic composite material strand through a second one of said plurality of first lane openings of said first lane transverse diaphragm of said first lane box beams, threading said third non-metallic composite material strand through a second one of said plurality of second lane openings of said second lane transverse diaphragm of said second lane box beams, and threading said third non-metallic composite material strand through an interstitial box beam opening of an interstitial box beam transverse diaphragm of said interstitial box beam.

15. The method of claim 14, wherein the steps of securing and post-tensioning said at least two first lane box beams in said transverse direction by said first non-metallic composite material strand to form said first lane structure and placing said deck slab over said first lane structure, said second lane structure and said interstitial box beam comprise the steps of:

firstly partially post-tensioning said at least two first lane box beams in said transverse direction by said first non-metallic composite material strand, secondly placing a first lane portion of said deck slab over said first lane structure, and thirdly completing the post-tensioning of said at least two first lane box beams in said transverse direction by said first non-metallic composite material strand.

16. The method of claim 15, wherein the steps of securing and post-tensioning said at least two second lane box beams in said transverse direction by said second non-metallic composite material strand to form said second lane structure and placing said deck slab over said first lane structure, said second lane structure and said interstitial box beam comprise the steps of:

firstly partially post-tensioning said at least two second lane box beams in said transverse direction by said second non-metallic composite material strand, secondly placing a second lane portion of said deck slab over said second lane structure, and thirdly completing the post-tensioning of said at least two second lane box beams in said transverse direction by said second non-metallic composite material strand.

17. The method of claim 16, wherein the steps of securing and post-tensioning said first lane structure, said second lane structure and said interstitial box beam in said transverse direction with said third non-metallic composite material strand and placing said deck slab over said first lane structure, said second lane structure and said interstitial box beam comprise the steps of:

firstly partially post-tensioning said first lane structure with said first lane portion of said deck slab, said second lane structure with said second lane portion of said deck slab and said interstitial box beam in said transverse direction with said third non-metallic composite material strand, secondly placing an interstitial box beam portion of said deck slab over said interstitial box beam, thirdly bonding together said first lane portion, said second lane portion and said interstitial box beam portion of said deck slab, and fourthly completing the post-tensioning of said first lane structure, said second lane structure and said interstitial box beam in said transverse direction with said third non-metallic composite material strand.

18. The method of claim 11, wherein the step of securing and post-tensioning said first lane structure, said second lane structure and said interstitial box beam in said transverse direction with said third non-metallic composite material strand comprises the steps of:

threading said third non-metallic composite material strand through a second one of a plurality of first lane openings of a first lane transverse diaphragm of said first lane box beams, threading said third non-metallic composite material strand through a second one of a plurality of second lane openings of a second lane transverse diaphragm of said second lane box beams, and threading said third non-metallic composite material strand through an interstitial box beam opening of an interstitial box beam transverse diaphragm of said interstitial box beam.

19. The method of claim 18, wherein the steps of securing and post-tensioning said at least two first lane box beams in said transverse direction by said first non-metallic composite material strand to form said first lane structure and placing said deck slab over said first lane structure, said second lane structure and said interstitial box beam comprise the steps of:

firstly partially post-tensioning said at least two first lane box beams in said transverse direction by said first non-metallic composite material strand, secondly placing a first lane portion of said deck slab over said first lane structure, and thirdly completing the post-tensioning of said at least two first lane box beams in said transverse direction by said first non-metallic composite material strand.

20. The method of claim 19, wherein:

the steps of securing and post-tensioning said at least two second lane box beams in said transverse direction by said second non-metallic composite material strand to form said second lane structure and placing said deck slab over said first lane structure, said second lane structure and said interstitial box beam comprise the steps of:

firstly partially post-tensioning said at least two second lane box beams in said transverse direction by said second non-metallic composite material strand, secondly placing a second lane portion of said deck slab over said second lane structure, and thirdly completing the post-tensioning of said at least two second lane box beams in said transverse direction by said second non-metallic composite material strand, and the steps of securing and post-tensioning said first lane structure, said second lane structure and said interstitial box beam in said transverse direction with said third non-metallic composite material strand and placing said deck slab over said first lane structure, said second lane structure and said interstitial box beam comprise the steps of:

firstly partially post-tensioning said first lane structure with said first lane portion of said deck slab, said second lane structure with said second lane portion of said deck slab and said interstitial box beam in said transverse direction with said third non-metallic composite material strand, secondly placing an interstitial box beam portion of said deck slab over said interstitial box beam, thirdly bonding together said first lane portion, said second lane portion and said interstitial box beam portion of said deck slab, and fourthly completing post-tensioning of said first lane structure, said second lane structure and said interstitial box beam in said transverse direction with said third non-metallic composite material strand.

* * * * *